United States Patent [19]

Donini

[11] 3,938,580

[45] Feb. 17, 1976

[54] CONTINUOUS METAL CASTING PLANT WITH CONTROLLED BAND-TENSIONING

[76] Inventor: Enrico Donini, C.so Indipendenza 6, 20129 Milan, Italy

[22] Filed: June 26, 1974

[21] Appl. No.: 483,439

[30] Foreign Application Priority Data

June 28, 1973 Italy ..... 25990/73

[52] U.S. Cl. ..... 164/154; 164/278

[51] Int. Cl.[2] ..... B22D 11/06

[58] Field of Search ..... 164/87, 278, 282, 154

[56] References Cited

UNITED STATES PATENTS

| | | | |
|---|---|---|---|
| 3,257,691 | 6/1966 | Krueger | 164/282 X |
| 3,682,234 | 8/1972 | Vogel | 164/278 |

*Primary Examiner*—Robert D. Baldwin

*Attorney, Agent, or Firm*—Michael J. Striker

[57] ABSTRACT

In a continuous metal casting plant which includes a casting wheel which has a peripheral groove, a metal endless band which winds partially about a portion of the circumference of the casting wheel so as to define a casting chamber for receiving molten metal and a crucible which is provided with nozzle for delivering the molten metal, the improvement being that the band is supported and tensioned by a pair of movable structures adapted to slide along a track, each structure having a shoulder and a plurality of rollers. One structure is fixedly secured to the track, and the other structure is movable by means of a piston actuated by sensitizers of the band via charge or load cells. The band is maintained pressed against the casting chamber of the wheel by means of two band presser means disposed on opposite sides of the wheel, each band presser means being mounted on an independently movable carriage which carries a multi-hinge arm and its associated pulley.

11 Claims, 3 Drawing Figures

CONTINUOUS METAL CASTING PLANT WITH CONTROLLED BAND-TENSIONING

This invention relates to an improved continuous metal casting plant, and more particularly to a continuous metal casting plant which is provided with separate and movable operating mechanical units which are adapted to ensure the use of casting wheels of different diameters.

As is well known, continuous metal casting plants as used heretofore, such as Bessemer, Properzi, Rigamonti plants and the like, are built of mechanical structures assembled in rigid units, generally called "casting machines".

These conventional casting plants show considerable operating limitations due to their rigid structure, which unquestionably involves a relatively fixed spacing between its various component parts. In particular, in the aforesaid casting machines, the length of the endless band which is wound partially about the casting wheel is determined by the structure of the machine itself, and therefore it is not suited for casting wheels of different diameters.

Consequently, the endless band is subjected to very frequent operating cycles, which involve a reduced lifetime for the endless band.

The limited extension of the endless bands makes it almost impossible to operate a continuous compensation of their elongation due to their certain expansion due to thermal effects caused by the molten metal;

For this reason, in conventional casting plants, there is a forced continuous tendency to resort to the use of steel bands, which have a sufficiently low linear expansion factor.

This solution leads, however, to the fact that generally speaking, the casting chambers (or throats) are formed of materials having heterogeneous material walls and uneven and varying thicknesses between the walls and the band.

It may be recalled here that copper or its alloys are generally used for the construction of the wheel, and steel is used for the band.

Furthermore, in conventional casting plants, the casting wheels are normally of a preset diameter, and the positioning devices of the other component parts of the casting plants are rather complex and only relatively movable.

On the other hand, it should be stressed here that the machines being at present commercially available which use wheels of various diameter require complicated modifications, dismantlings and re-placement parts for changing from one diameter to another.

Finally, in the same conventional casting machines, the melting crucibles and nozzles pertaining to unit mechanical constructions always waste an appreciable amount of time for their assembly, disassembly, replacement and positioning.

The execution of these mechanical operations implies likewise the stopping of the casting plant which results in consequent serious damages to the continuity of the operating cycle.

The above-mentioned disadvantage and other practical inconveniences are remedied by the continuous casting plant according to the present invention.

In the continuous casting plant of this invention, the return rollers of the endless band may be in fact caused to slide along a proper track, which may be placed, according to requirements, above or below the operating surface.

Of the aforesaid return rollers, one is fixedly secured to the most suitable position; whereas, the other one is conveniently maintained under tension and acts substantially as a band-stretching or tensioning roller.

Consequently, in the continuous casting plant of this invention, it is possible to use bands made from copper or copper alloys, since the elongations of the bands themselves are automatically compensated for. The pair of units which press the band against the casting wheel are further movable, too, they being preferably sliding over a track in line with the casting axis.

By this arrangement, it is possible to quickly replace the band and use wheels of different diameters.

In the continuous casting plant of this invention, furthermore, the crucible-nozzle units consist of movable mechanical structures, provided with connecting members and hinges adapted to adjust the height of the nozzle, the inclination and the crucible swing. The units are further displaceable, generally on small wheels, and one provided with proper hook levers for fastening the units to the floor in operating position. These and further characteristic features of a functional and constructional nature of the continuous metal casting plant according to the present invention could be better understood from the following detailed description taken in conjunction with the accompanying drawings; in which:

Figure 1:
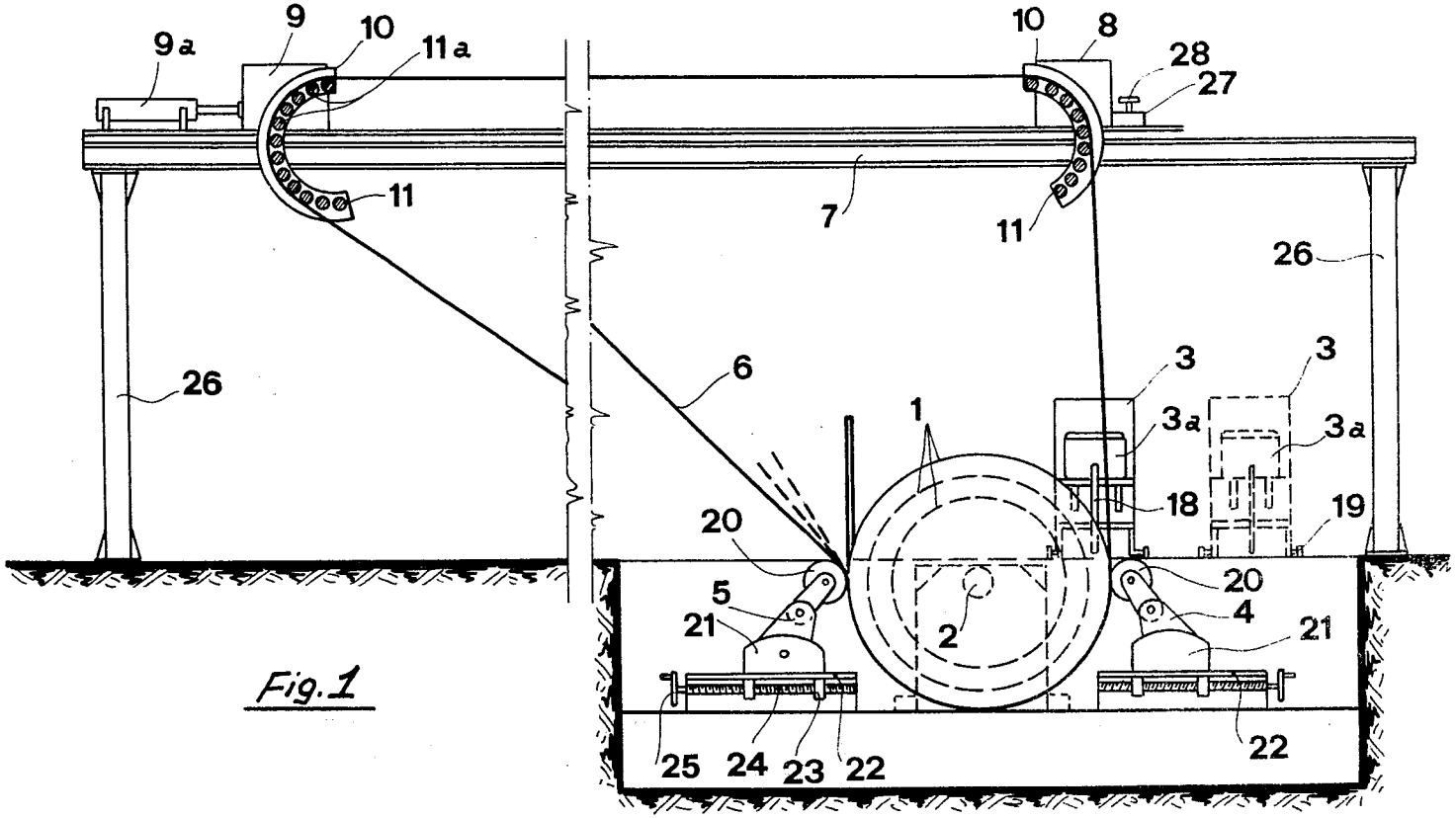
FIG. 1 shows an embodiment of the continuous metal casting plant of this invention in a schematic front view.
Figure 2:
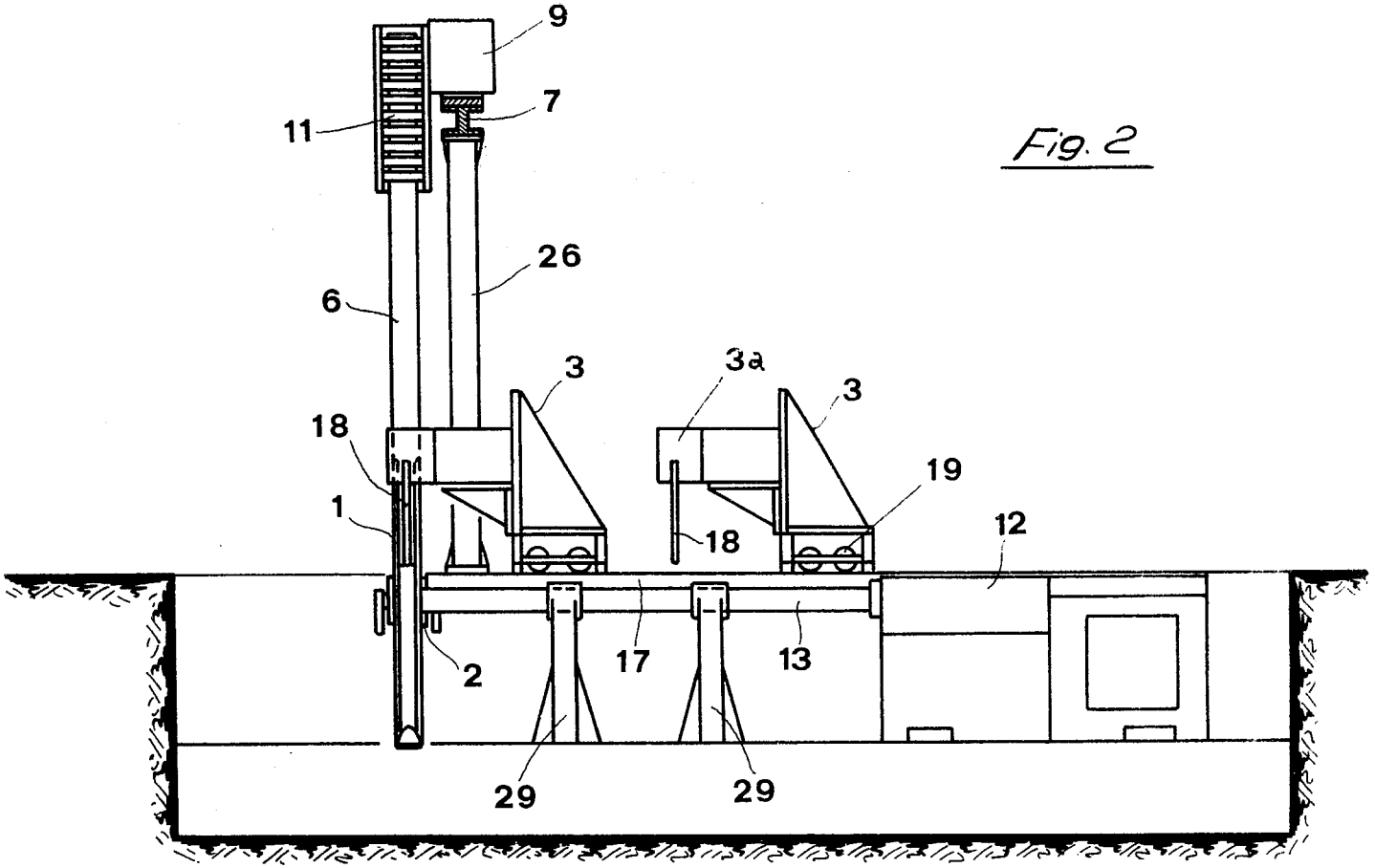
FIG. 2 shows the embodiment of FIG. 1 in a cross-sectional view.

Referring now particularly to the reference numerals contained in the figures on the accompanying drawing, the continuous metal casting plant according to the present invention includes a casting wheel 1 which is mounted on a hub 2.

The hub 2 is placed underneath the operating surface, and casting wheels of different sized diameters are adapted to be fixedly secured on hub 2, as required by the particular structure involved in the casting plant.

Above the operating surface, there are placed pairs of tracks 17, along which units 3 are adapted to slide, including essentially a crucible 3a provided with a nozzle 18. More particularly, the units 3 are mechanical assemblies which are provided with members and hinges which are adapted to ensure a variation, according to requirements in the height, inclination and swing of the crucible 3a which is supported by the units.

The units are generally displaceable on small wheels 19 and are further provided with proper hook levers for fastening the units 3 to the floor when they are in operating position. Preferably, the fastening is carried out by engaging the hook levers in holes provided on the operating floor in the vicinity of the casting wheel 1.

It should be noted here that the availability of spare units 3 permits the option of previously preparing the crucibles 3a so that the replacement of the crucibles themselves may take place in a very short time.

The replacement in fact does not require special modifications and/or displacements, expect for the removal of the unit 3 which is replaced by the approach of a new unit. In the same simple manner, it is possible to change the casting point, should a wheel 1 of different diameter be used; in such event, it will in fact suffice to vary the height and, if necessary, the inclination of the crucible 3a on the units 3.

Underneath the operating surface, there is disposed a band pressing unit 4 which comprises a multi-hinge arm that is adapted to ensure an exact positioning of the guide pulley 20.

On the opposite side of the axis of the hub 2, there is placed a second unit 5, which is likewise provided with hinges and guide pulley 20 and which may also incorporate the stripper of the cast bar or the rolled strip.

The aforementioned band-pressing units 4 and 5 are preferably mounted on a carriage 21 which slides over the tracks 22 and is helically connected via one or more threaded bushings 23 to a female screw 24 which is actuated by means of a handwheel 25.

The moveability of band-pressing units 4 and 5 ensures both a quick change of the endless band 6 and its use without the need for conversions of the wheels 1 of different diameter.

The casting band 6 is not subject to particular length limitations and may be made of material having a high linear expansion factor, such as copper and its alloys.

More generally speaking, the band 6 may be made of material having linear expansion factor closely matching the material used for making the casting wheels 1.

The band 6 is supported by a pair of structures 8 and 9 which slide along a horizontal track 7. The track 7 is generally elevated above the wheel 1 and may rest on pillars 26, or hung to the ceiling, or otherwise installed depending on the individual requirements. The track 7 may further extend an indefinite length being only practically limited by the space available on the site.

The sliding structurs 8 and 9 are provided with shoulders 10 which are fitted with a plurality of loose rollers 11 or pulleys for guiding the band 6.

The structure 8 is preferably tangentially positioned relative to the horizontal diameter of the wheel 1 and its casting point by means of suitable fastening members which may be constituted of, for example, pairs of pressure screws which are actuated by the handwheel 28.

The structure 9 is then in turn, positioned depending upon the length of the band 6 and the desired tension to be imparted thereto, thus automatically adjusting the band.

To this end, some of the rollers 11a are movable and serve as sensors, which continuously control the tension of the band 6 via proper load cells.

The load cells displace electronically the structure 9 by means of a piston 9a mounted integrally the track 7 so as to compensate for changes in length of the band 6 resulting from heat expansion.

It should be noted here that in view of the mobility of the structures 8 and 9, the band 6 may be used also after eventual cuttings and removal of worn out portions until it reaches the minimum permitted size. The wheel carrying hub 2 is driven by the speed reducer 12, via the shaft 13, and is mounted on two or more support means 29.

Figure 3:
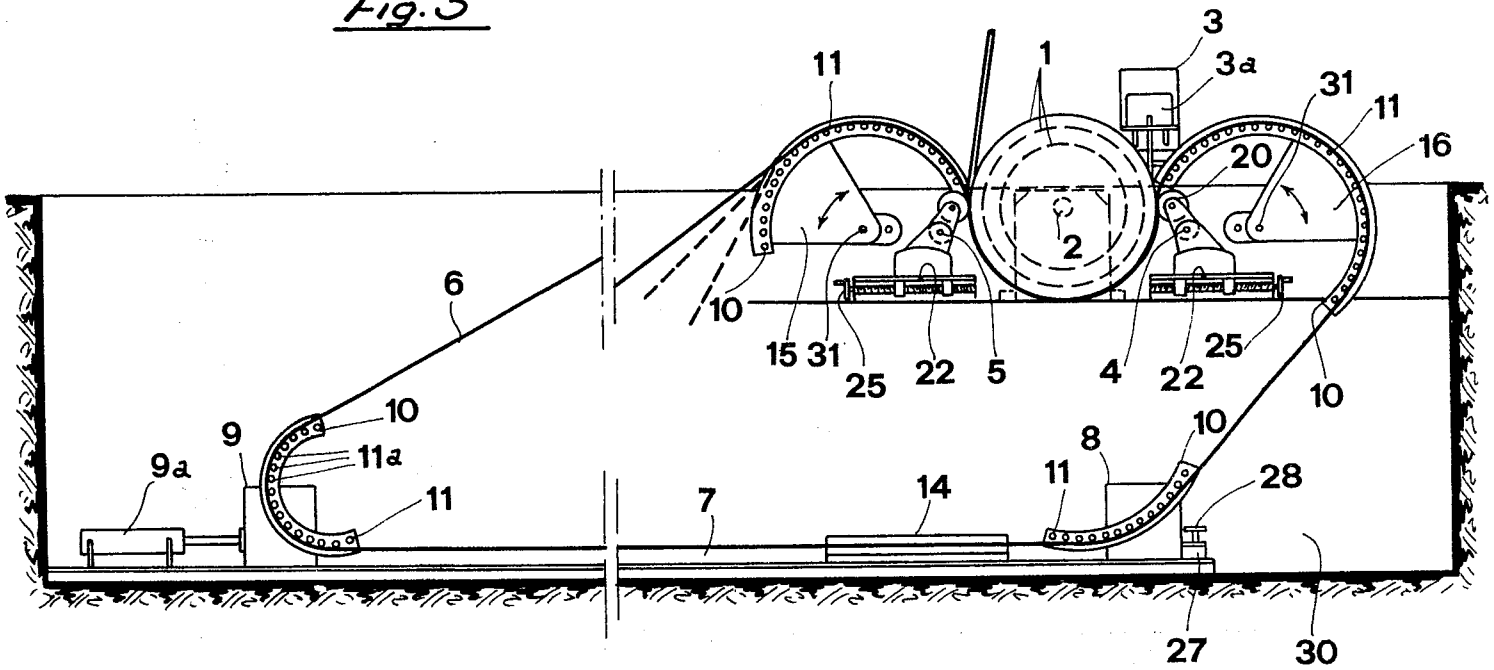
FIG. 3 shows an alternative embodiment with the return rollers of the endless band placed underneath the operating surface.

According to an alternative embodiment form (FIG. 3) of this invention, the movable structures 8 and 9 may be accommodated in a hole 30, and they may slide along a track 7 on the ground, thus making possible the use of a tunnel 14 for straightening and conditioning the band 6.

In this case, the band 6 is supported on the working surface by a pair of shoulders 15 and 16 which is provided with a plurality of loose rollers 11.

The shoulders 15 and 16 rotate about the pivots 31 in order to ensure a variation in the position of the band 6 in relation to the diameter of the wheel 1 and the casting point.

The continuous metal casting plant of this invention has been described and illustrated by way of non-limiting embodiment examples and demonstrate the novel and innovative features characterizing its increased functional character, so that several changes and modifications as well as improvements may be introduced therein, without departing from the very spirit of this invention, it being understood that any such changes and modifications or improvements shall be deemed as falling into, and appertaining to, the scope and protection of this invention.

I claim:

1. In a system for the continuous casting of elongated metal elements from hot molten metal, a combination comprising a casting wheel having an axis and a peripheral groove; a metallic endless band entrained about a portion of the circumference of said wheel so as to overlie said groove in said portion and define a casting chamber therewith; crucible means including a nozzle for admitting hot molten metal into said casting chamber; band-tensioning means including a horizontal track and a pair of band-supporting members slidable on said track and each having roller means for entraining said band at locations spaced from said wheel, said band-tensioning means also having means for fixedly securing one of said members to said track and control means for moving the other of said members along said track, said control means including sensor means for sensing the tension of said band and piston means connected with said other member and cooperating with said sensor means to move said other member away from said one member and thereby maintain said band tensioned; and a pair of band-presser means disposed on opposite sides of said axis for respectively pressing said band against the circumferential surface of said wheel, each of said band-presser means having a movable carriage, a multi-hinged arm and a pulley on said arm.

2. A combination as defined in claim 1, wherein said crucible means further comprises at least one crucible having wheels adapted for movement on an operating surface located substantially at the level of admission of said hot molten metal into said casting chamber; and further comprising adjusting means on said crucible means for adjusting the position of said one crucible relative to said operating surface.

3. A combination as defined in claim 2; and further comprising locking means having hooks for fixedly securing said crucible means to said operating surface when said one crucible is in operating condition adjacent said casting chamber.

4. A combination as defined in claim 1, wherein said casting wheel and said band are both constituted of a metal material having substantially equal thermal expansion factors.

5. A combination as defined in claim 4, wherein said band and said casting wheeel are constituted of a metal material selected from the group consisting of copper and its alloys.

6. A combination as defined in claim 2, wherein said horizontal track of said band-tensioning means is located above said operating surface.

7. A combination as defined in claim 6, and further comprising a pair of support pillars, and wherein said horizontal track of said band-tensioning means is supported from below by said pair of pillars.

8. A combination as defined in claim 6; and further comprising an elevated ceiling support, and wherein said horizontal track of said band-tensioning means is supported from above by said ceiling support.

9. A combination as defined in claim 2, wherein said horizontal track of said band-tensioning means is located underneath said operating surface, and wherein said roller means entrains said band at spaced locations disposed at opposite sides of said axis.

10. A combination as defined in claim 9; and further comprising means for straightening said band on said horizontal track, said straightening means comprising an elongated member having a longitudinal socket which is adapted to receive and straighten said band as it passes therethrough.

11. A combination as defined in claim 1; and further comprising additional casting wheels, each having differently-sized diameters and a hub portion adapted to interchangeably mount said additional casting wheels on said axis, and wherein said movable carriage of each of said band-presser means is movable in order to firmly press said band against a selected one of said casting wheels mounted on said axis.

* * * * *